US007882849B2

(12) United States Patent
Franta

(10) Patent No.: US 7,882,849 B2
(45) Date of Patent: Feb. 8, 2011

(54) FLAME RESISTANT INSULATED FABRIC FOR SHELTERS

(76) Inventor: Matt Franta, 6459 Alvarado La. North, Maple Grove, MN (US) 55374

( * ) Notice: Subject to any disclaimer, the term of this patent is extended or adjusted under 35 U.S.C. 154(b) by 0 days.

(21) Appl. No.: 12/154,199

(22) Filed: May 21, 2008

(65) Prior Publication Data

US 2008/0289674 A1 Nov. 27, 2008

Related U.S. Application Data

(60) Provisional application No. 60/931,084, filed on May 21, 2007.

(51) Int. Cl.
*E04H 15/54* (2006.01)

(52) U.S. Cl. ..... 135/115; 135/901

(58) Field of Classification Search ..... 135/115, 135/901; 169/48, 50
See application file for complete search history.

(56) References Cited

U.S. PATENT DOCUMENTS

| | | | | |
|---|---|---|---|---|
| 2,932,304 | A | | 4/1960 | Voege et al. |
| 3,598,133 | A | | 8/1971 | Abert et al. |
| 4,391,865 | A | | 7/1983 | Constance |
| 4,397,346 | A | | 8/1983 | Chumbley et al. |
| 4,569,874 | A | | 2/1986 | Kuznetz |
| 4,608,298 | A | | 8/1986 | Klaff |
| 4,705,717 | A | | 11/1987 | Cain et al. |
| 4,956,218 | A | * | 9/1990 | Haining ..... 428/102 |
| 5,100,725 | A | | 3/1992 | Pearson |
| 5,393,598 | A | | 2/1995 | Schlecker |
| 5,490,567 | A | * | 2/1996 | Speer ..... 169/50 |
| 5,571,592 | A | | 11/1996 | McGregor et al. |
| 6,100,208 | A | | 8/2000 | Brown et al. |
| 6,253,777 | B1 | * | 7/2001 | Anderson ..... 135/115 |
| 7,188,397 | B2 | * | 3/2007 | Hartgrove et al. ..... 28/104 |
| 2006/0191903 | A1 | * | 8/2006 | Naylor et al. ..... 219/528 |
| 2007/0223092 | A1 | * | 9/2007 | Moreau ..... 359/529 |

FOREIGN PATENT DOCUMENTS

| | | | |
|---|---|---|---|
| GB | 2249523 A | * | 5/1992 |
| WO | WO 00/66846 | | 11/2000 |

* cited by examiner

*Primary Examiner*—David Dunn
*Assistant Examiner*—Danielle Jackson
(74) *Attorney, Agent, or Firm*—Kinney & Lange, P.A.

(57) ABSTRACT

A flame-resistant fabric for shelters including a flame-resistant interior layer, an flame-resistant, insulating middle layer adjacent the interior layer, a flame-resistant exterior layer adjacent the insulating middle layer, and at least one threaded seam quilting the insulating middle layer between the interior layer and the exterior layer to form a flame-resistant fabric. The flame-resistant fabric is capable of being formed into a flame-resistant, insulated shelter for use in extreme weather.

33 Claims, 2 Drawing Sheets

FLAME RESISTANT INSULATED FABRIC FOR SHELTERS

CROSS-REFERENCE TO RELATED APPLICATION(S)

This application claims priority from provisional application No. 60/931,084 filed May 21, 2007, for "Ice Fishing Shelter", which is hereby incorporated by reference.

BACKGROUND

Insulation provides warmth by entrapping air. Natural insulators, such as wool or feathers, and synthetic insulators made of polymer fibers are well known. Insulated fabrics are used for protection against cold and sometimes for protection against other outdoor elements such as wind, rain, sleet and snow. For example, insulated fabrics are found in outdoor apparel, blankets, and window liners. Insulated fabrics are not, however, found in cold-weather shelters.

Traditional cold-weather shelters, such as ice fishing huts and winter tents, are made out of non-insulated canvas. Cloth shelters fail to provide sufficient warmth or ventilation because they "sweat or frost up" from moisture and melting ice. Cold exterior temperatures abut heat and moisture from the interior of the shelter causing interior condensation problems. Health issues, such as nausea and sickness from prolonged exposure to heating sources, are known to plague ice fishermen that dwell for long hours in traditional canvas shelters. Furthermore, cloth shelters are costly both financially and environmentally because they lack sufficient thermal resistance.

SUMMARY

Exemplary embodiments of the invention include a flame-resistant fabric for shelters having a flame-resistant interior layer, a flame-resistant insulating middle layer adjacent the interior layer, a flame-resistant exterior layer adjacent the insulating middle layer, and at least one threaded stitch quilting the insulating middle layer between the interior layer and the exterior layer to form a flame-resistant fabric.

Exemplary embodiments also include a shelter having at least one wall made of flame-resistant fabric including a flame-resistant interior layer, a flame-resistant insulating middle layer adjacent the interior layer, a flame-resistant exterior layer adjacent the insulating middle layer, and at least one threaded stitch quilting the insulating middle layer between the interior layer and the exterior layer to form a flame-resistant fabric, and an opening in the wall for entering and exiting the shelter.

In addition, exemplary embodiments of the invention include a method of making a shelter having the steps of: placing a flame-resistant insulating middle layer between a flame-resistant interior layer and a flame-resistant exterior layer, quilting the middle layer between the interior layer and the exterior layer to form a flame-resistant fabric, and forming the flame-resistant fabric into a shelter.

DETAILED DESCRIPTION

An insulated, flame-resistant fabric is described. The fabric combines the warmth and comfort of insulation with the safety of flame-resistance. The fabric may be incorporated into cold-weather shelters such as, but not limited to, ice fishing shelters.

Figure 1:
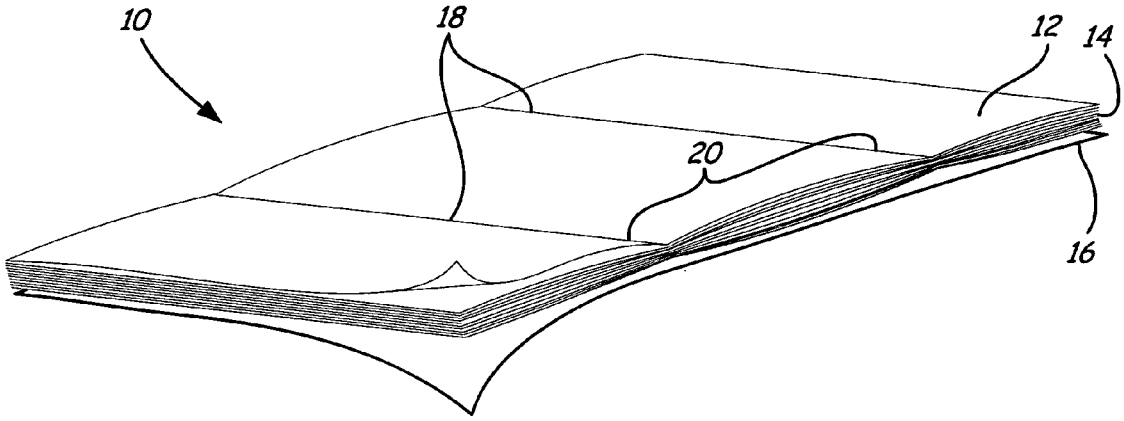
FIG. 1 is a close-up of a section of a flame-resistant fabric.

FIG. 1 is a close-up of a section of flame-resistant fabric 10. Flame-resistant fabric 10 includes three layers: interior layer 12, insulating middle layer 14, and exterior layer 16. Insulating middle layer 14 is adjacent interior layer 12, and exterior layer 16 is adjacent insulating middle layer 14, so that insulating middle layer 14 is sandwiched between interior layer 12 and exterior layer 16. Interior layer 12, insulating middle layer 14, and exterior layer 16 are quilted together by stitch 18. Stitch 18 is repeated at interval 20.

Interior layer 12 is flame-resistant and preferably "flame retardant" certified to meet CPAI-84 technical specs for Industrial Camping Tentage Industry. Interior layer 12 may be light in color (such as white, light gray, or metallic) and reflect light and/or heat. Interior layer 12 may include water, stain, mold, and/or mildew resistant coatings. Interior layer 12 may be a coated fabric consisting of polyester, cotton, nylon, vinyl or a blend thereof. For example, interior layer 12 may be a gray colored coated polyester flame-resistant fabric. Preferably, interior layer 12 is vapor-permeable and rugged.

Insulating middle layer 14 is flame-resistant and preferably "flame retardant" certified to meet CPAI-84 technical specs for Industrial Camping Tentage Industry. Insulating middle layer 14 may have a basis weight greater than approximately 2.0 ounces per yard squared, a thickness greater than approximately 0.15 inches, and/or an R-Value greater than approximately 0.2. R-Value is a method used to show the thermal resistance of a particular material achieved by retarding the flow of heat through the material itself rather than reflecting radiant heat away. The higher the R-value, the greater the insulation. In some embodiments, insulating middle layer 14 may exhibit an R-Value of 1.4, which is approximately fourteen times the thermal resistance of standard non-insulated fabric composites (such as canvas). Clo units are closely related to R-value; each do unit represents the standard amount of insulation required to keep a resting person warm in a windless room at 70° F. Insulating middle layer 14 may include a blend of Modacrylic, Aramid, and Polyester fibers commercially available under the trademark "Thinsulate". In some embodiments, insulating middle layer 14 includes Thinsulate™ Insulation FR by 3M.

| 3M Thinsulate ™ Insulation FR<br>55% Modacrylic, 30% Aramid, 15% Polyester | | |
|---|---|---|
| Properties Basis/Weight | oz/yd | 3.5 |
| Thickness | cm | 0.72 |
| | in | 0.29 |
| Thermal Resistance | clo | 1.8 |
| | R-value | 1.6 |

Exterior layer 16 is flame-resistant and preferably "flame retardant" certified to meet CPAI-84 technical specs for Industrial Camping Tentage Industry. Exterior layer 14 may be dark in color (such as black, blue, or dark gray) and absorb light/and or heat. Exterior layer 14 may be treated for prolonged outdoor use and exposure to all weather conditions including extreme cold or intense UV. Exterior layer 14 may be a coated fabric consisting of polyester, cotton, nylon, vinyl or a blend thereof. For example, exterior layer 16 may be dark colored coated polyester flame-resistant fabric. Exterior layer 14 may also be vapor-permeable, liquid water-repellant, rugged, and windproof.

Interior layer 12, insulating middle layer 14, and exterior layer 16 are quilted together by stitch 18 to form a flame-resistant fabric 10. Flame-resistant fabric 10 may have a basis weight greater than approximately 2.5 ounces per yard squared, a thickness greater than approximately 0.25 inches, and/or an R-value greater than approximately 0.2. Stitch 18 may be repeated at interval 20 to produce parallel quilt lines down the entire length of each material panel. When stitch 18 is repeated at interval 20, any shifting of middle insulating layer 14 with respect to interior layer 12 and exterior layer 16 is reduced. Interval 20 may be anywhere from approximately 5 inches to approximately 25 inches. Preferably, interval 20 is between approximately 10-20 inches.

In some embodiments, stitch 18 is produced by a needle and thread. The act of stitching stitch 18 with a needle and thread may introduce a plurality of small holes into the interior layer 12, insulating middle layer 14, and exterior layer 16. The holes created by the thread used to quilt flame-resistant fabric 10 are advantageous because they allow for the flame-resistant fabric to "breathe". While small holes allow for flame-resistant fabric 10 to breathe, the holes are not sufficiently large to negate the insulative features of flame-resistant fabric, 10. When flame-resistant fabric 10 includes stitch 18 repeating at interval 20, flame-resistant fabric 10 breathes in a uniform matter, which would be particularly advantageous when flame-resistant fabric is used to form a cold-weather shelter, such as an ice fishing shelter.

Figure 2:
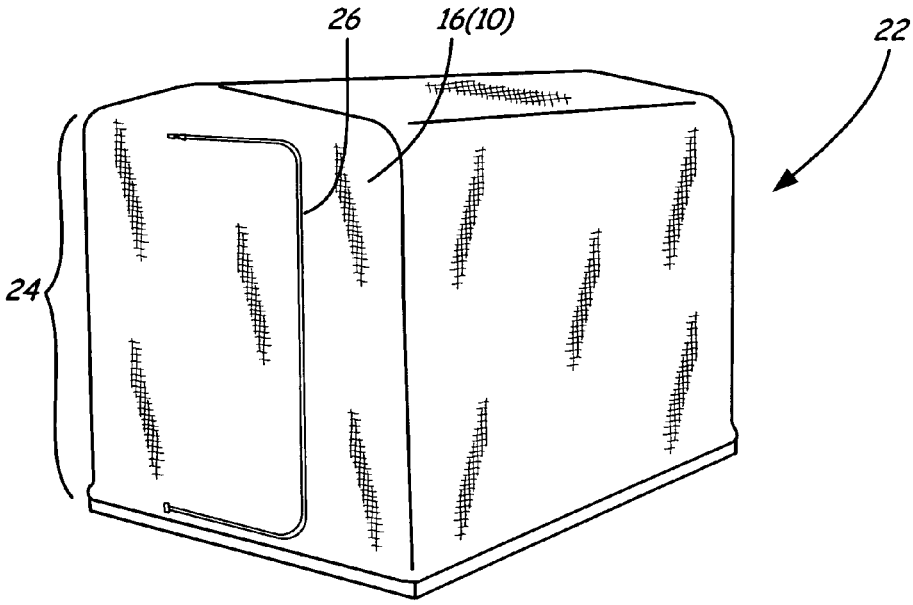
FIG. 2 is a perspective view of an exterior of an ice fishing shelter made of flame-resistant fabric.

FIG. 2 is a perspective view of an exterior of ice fishing shelter 22 made of flame-resistant fabric 10. Ice fishing shelter 22 includes a ceiling and a plurality of side walls, of which wall 24 is but one example. Wall 24 is made of flame-resistant fabric 10, but only exterior layer 16 is visible from the exterior perspective view provided in FIG. 2. Flame-resistant fabric 10 is durable yet remains pliable in almost any weather conditions. Opening 26 in wall 24 allows for a user to enter and exit ice fishing shelter 22. If flame-resistant fabric 10 is edged, the edges may be serged or otherwise finished. Ice fishing shelter 22 may be lightweight and pliable to allow for easing breakdown and folding. Ice fishing shelter 22 depicts the typical structural architecture of an ice shelter, but the invention is not so limited. Flame-resistant fabric 10 is applicable to any temporary structure where insulating properties are needed. Ice fishing shelter 22 merely illustrates a context where use of flame-resistant fabric 10 would be advantageous. Another example is a tent for cold-weather camping. Yet another example is a liner for commercial tents used in extreme weather.

Figure 3:
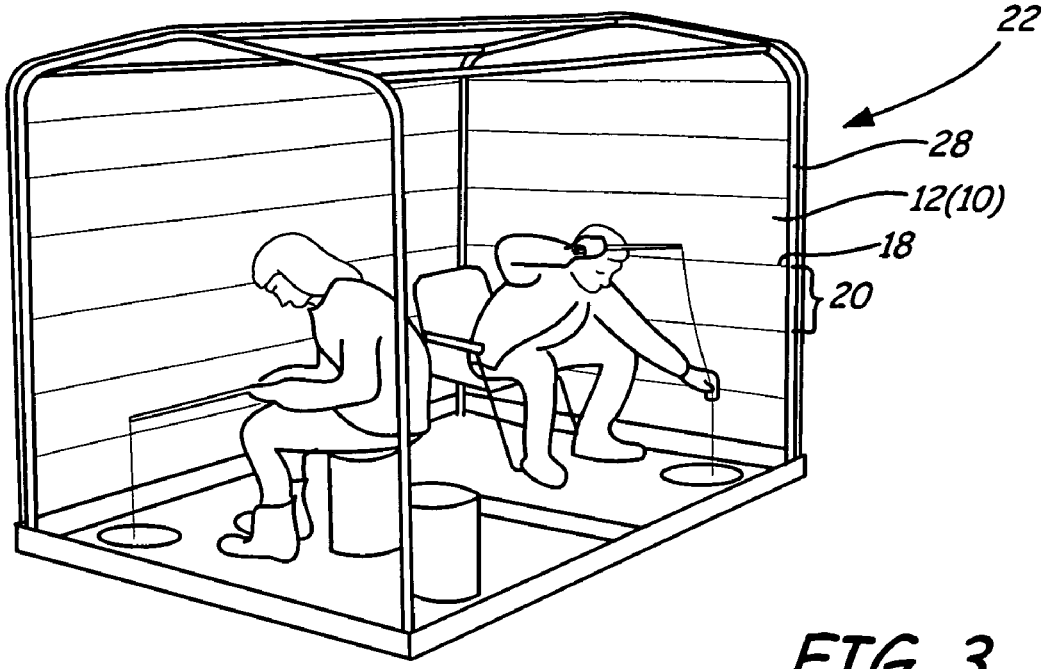
FIG. 3 is a perspective view of an interior of an ice fishing shelter made of flame-resistant fabric.

FIG. 3 is a perspective view of the interior of ice fishing shelter 22 made of flame-resistant fabric 10 attached to and surrounding collapsible and erectable frame 28. Frame 28 may be metal tubing, plastic tubing, fiber-glass tubing, or any combination thereof. Of flame-resistant fabric 10, interior layer 12, stitch 18, and interval 20 are visible in FIG. 3. Stitch 18 is repeated at interval 20 throughout flame-resistant fabric 10 to provide even quilting, which results in the walls of ice fishing shelter 22 breathing in a uniform matter. Walls that breathe in a uniform matter may avoid localized condensation problems. Stitch 18 may include polyester thread with mold, mildew, and UV treatments. Stitch 18 may be finished with a variety of binding and edging products including, but not limited to, vinyl, polyester, nylon, and/or heat sealing applied with the appropriate technique as known in the art.

Figure 4:
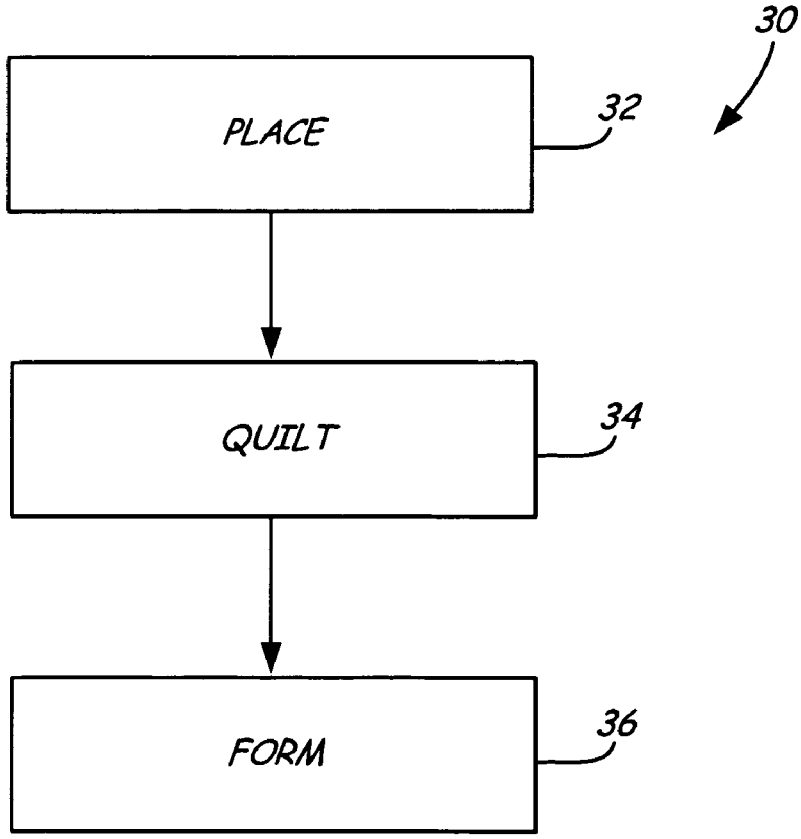
FIG. 4 is a block diagram of a method of making a shelter out of flame-resistant fabric.

FIG. 4 is a block diagram of method 30 including: placing a middle layer between an interior layer and an exterior layer (step 32), quilting the middle layer between the interior layer and the exterior layer to form a flame-resistant fabric (step 34); and forming the fabric into a shelter (step 36). Placing a middle layer between an interior layer and an exterior layer (step 32) includes placing middle layer (such as insulating middle layer 14 from FIG. 1) adjacent interior layer (such as interior layer 12 from FIG. 1) and also adjacent exterior layer (such as exterior layer 16 from FIG. 1) so that middle layer is sandwiched between interior layer and exterior layer (as depicted in FIG. 1). Quilting the middle layer between the interior layer and the exterior layer to form a flame-resistant fabric (step 34) may include stitching (such as stitch 18 from FIG. 1) at intervals (such as interval 20 from FIG. 1) to form a quilted flame-resistant fabric (such as flame-resistant fabric 10 from FIG. 1). Quilting the middle layer between the interior layer and the exterior layer (step 34) may also include punching holes through the middle, interior, and exterior layers so that the fabric may breathe. Forming the fabric into a shelter (36) may include serging edges and sewing, welding, or otherwise joining pieces of flame-resistant fabric together into a structure resembling a tent (such as ice fishing shelter 22 from FIGS. 2 and 3). Method 30 results in a flame-resistant, insulated shelter perfect for the serious winter fisherman.

EXAMPLE 1

Minnesota Mining and Manufacturing Co. (3M), of Saint Paul, Minn., developed fire-resistant insulation sold under the trademark "THINSULATE". Unlike the insulations developed before, Thinsulate™ Insulation FR is fire-resistant. Thinsulate™ Insulation FR, quilted between an inner and outer shell, does meet or exceed the industry flame resistance safety standard, Camping Products Association International (CPAI-84). The current physical requirements for flame-resistant materials used in camping tentage (CPAI-84, Section 6, wall and top material) include:

- No individual specimen shall have an afterflame of more than 4.0 seconds.
- The average afterflame time for all specimens in a sample unit shall not exceed 2.0 seconds.
- Portions or residues that break or drip from the test specimens shall not continue to flame after they strike the burner platform.

Current CPAI-84 testing for wall and top material requires test specimens to measure 70 mm by 300 mm with the long dimensions parallel to either the warp or filling directions of the material. Testing for wall and top material requires that specimens be examined in three conditions: 1) original, 2) leached (immersed in water for 72 hours, removed and air-dried prior to testing), and 3) weathered (subjected to 60 hours of the fluorescent UV and condensation method of accelerated weathering). For each test condition, CPAI-84 requires eight individual specimens, four taken from the wrap and four from the fill direction of the test material. Testing includes suspending a specimen in an apparatus and subjecting the lower edge of the specimen to 12 seconds of flame at which time the burner is turned off. If the specimen flames after the burner is turned off, then after-flame time is recorded to the nearest 0.2 seconds. If a piece of specimen falls off, then drip burn is recorded. After both flaming and glowing have ceased, the damaged length is measured and recorded as char length. CPAI-84 Results of NorpacR2™ with Thinsulate™ Insulation FR are contained in the following three tables:

Original

| Specimen | After-flame | Drip Burn | Char Length |
|---|---|---|---|
| Length 1 | 0.0 Seconds | 0.0 | 2.7 Inches |
| Length 2 | 0.0 Seconds | 0.0 | 2.3 Inches |
| Length 3 | 0.0 Seconds | 0.0 | 2.4 Inches |
| Length 4 | 0.0 Seconds | 0.0 | 2.0 Inches |
| Width 1 | 0.0 Seconds | 0.0 | 2.4 Inches |
| Width 2 | 0.0 Seconds | 0.0 | 2.4 Inches |
| Width 3 | 0.0 Seconds | 0.0 | 2.5 Inches |
| Width 4 | 0.0 Seconds | 0.0 | 2.4 Inches |
| | 0.0 Seconds | | 2.4 Inches |

After 72 Hours Leaching

| Specimen | After-flame | Drip Burn | Char Length |
|---|---|---|---|
| Length 1 | 0.0 Seconds | 0.0 | 3.1 Inches |
| Length 2 | 0.0 Seconds | 0.0 | 2.7 Inches |
| Length 3 | 0.0 Seconds | 0.0 | 2.5 Inches |
| Length 4 | 0.0 Seconds | 0.0 | 2.5 Inches |
| Width 1 | 0.0 Seconds | 0.0 | 2.4 Inches |
| Width 2 | 0.0 Seconds | 0.0 | 2.5 Inches |
| Width 3 | 0.0 Seconds | 0.0 | 2.7 Inches |
| Width 4 | 0.0 Seconds | 0.0 | 2.2 Inches |
| | 0.0 Seconds | | 2.6 Inches |

After 60 Hours Weathering

| Specimen | After-flame | Drip Burn | Char Length |
|---|---|---|---|
| Length 1 | 0.0 Seconds | 0.0 | 2.2 Inches |
| Length 2 | 0.0 Seconds | 0.0 | 2.1 Inches |
| Length 3 | 0.0 Seconds | 0.0 | 2.2 Inches |
| Length 4 | 0.0 Seconds | 0.0 | 2.0 Inches |
| Width 1 | 0.0 Seconds | 0.0 | 1.7 Inches |
| Width 2 | 0.0 Seconds | 0.0 | 2.0 Inches |
| Width 3 | 0.0 Seconds | 0.0 | 2.1 Inches |
| Width 4 | 0.0 Seconds | 0.0 | 2.2 Inches |
| | 0.0 Seconds | | 2.1 Inches |

EXAMPLE 2

Insulated, fire-resistant shelter fabric (NorpacR2™ Fabric with Thinsulate™ Insulation FR Type 120) was compared to standard ice fishing shelter fabric (polyester and cotton blend fabric by Canvas Craft). Thickness measurements were determined using the 3M thickness tester having a test surface of 12 inches square. The reading was taken to the nearest hundredth centimeter with the same under a pressure of 0.002 psi. The insulation values of the samples were measured on a guarded hot plate, which measures the heat transfer from a hot plate through the sample into a cold environment. The thermal resistance (Clo value & R value) of the sample is determined under equilibrium conditions with 1 meter/second air blowing across the surface. Total Thermal Resistance of Insulation Value (Rcf) represents the insulation of the sample and the boundary of air. Thermal Resistance of the sample alone, Rcf, represents the insulation value of the sample with the Base Plate value of 0.43 Clo subtracted out. Experimental Results are contained in the following table:

| | Basis Weight | | Thickness | | Thermal Resistance, $R_{cf}$ | | |
|---|---|---|---|---|---|---|---|
| Material ID | $g/m^2$ | $oz/yd^2$ | cm | inch | Clo | R-value | $m^2$ K/W |
| Standard | 400 | 11.8 | 0.10 | 0.04 | 0.12 | 0.10 | 0.018 |
| Insulated fire-resistant | 405 | 11.9 | 0.80 | 0.31 | 1.6 | 1.4 | 0.24 |

The insulated, fire-resistant shelter fabric exhibited 14 times the thermal resistance (Clo and R-value) as the standard ice fishing shelter fabric, which equates to a 1300% increase in thermal resistance. This significant increase in thermal resistance would be expected to greatly diminish the amount of energy required to maintain a comfortable temperature inside an outdoor shelter.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A shelter comprising:

at least one wall made of flame-resistant fabric, the flame-resistant fabric comprising:

a flame-resistant interior layer;

a flame-resistant, insulating middle layer adjacent the interior layer, the middle layer comprising a blend of modacrylic, aramid, and polyester fibers;

a flame-resistant exterior layer adjacent the insulating middle layer; and a threaded stitch quilting the insulating middle layer between the interior layer and the exterior layer to form a quilted flame-resistant fabric, the threaded stitch being repeated at a regular interval to produce at least three parallel quilt lines extending along an entire length of the fabric; and an opening in the wall for entering and exiting the shelter.

2. The shelter of claim 1, wherein the threaded stitch is repeated at an interval of approximately 5-25 inches.

3. The shelter of claim 2, wherein the threaded stitch includes a plurality of holes extending through the flame-resistant fabric.

4. The shelter of claim 3, wherein the shelter is portable.

5. The shelter of claim 4, wherein the shelter is a tent.

6. The shelter of claim 5, wherein the shelter is an ice fishing shelter.

7. The shelter of claim 1, wherein the flame-resistant fabric has a basis weight greater than approximately 2.5 ounces per yard squared.

8. The shelter of claim 7, wherein the flame-resistant fabric has a thickness greater than approximately 0.25 inches.

9. The shelter of claim 8, wherein the flame-resistant fabric has an R-value greater than approximately 0.2.

10. The shelter of claim 1, wherein the insulating middle layer has a basis weight greater than approximately 2.0 ounces per yard squared.

11. The shelter of claim 10, wherein the insulating middle layer has a thickness greater than approximately 0.15 inches.

12. The shelter of claim 11, wherein the insulating middle layer has an R-value greater than approximately 0.2.

13. A shelter comprising:

a collapsible and erectable frame;

a ceiling and a plurality of side walls attached to and surrounding the frame to form a shelter, the ceiling and side walls made of flame-resistant fabric, the flame-resistant fabric comprising:

a flame-resistant interior layer;

a flame-resistant, insulating middle layer adjacent the interior layer, the middle layer comprising a blend of modacrylic, aramid, and polyester fibers;

a flame-resistant exterior layer adjacent the insulating middle layer; and a threaded stitch quilting the insulating middle layer between the interior layer and the exterior layer to form a quilted flame-resistant fabric, the threaded stitch being repeated at a regular interval to produce at least three parallel quilt lines extending along an entire length of the fabric; and an opening in at least one side wall for entering and exiting the shelter.

14. The shelter of claim 13, wherein the threaded stitch is repeated at an interval of approximately 5-25 inches.

15. The shelter of claim 14, wherein the threaded stitch includes a plurality of holes extending through the flame-resistant fabric.

16. The shelter of claim 15, wherein the flame-resistant fabric has a basis weight greater than approximately 2.5 ounces per yard squared.

17. The shelter of claim 16, wherein the flame-resistant fabric has a thickness greater than approximately 0.25 inches.

18. The shelter of claim 17, wherein the flame resistant fabric has an R-value greater than approximately 0.2.

19. The shelter of claim 18, wherein the insulating middle layer has a basis weight greater than approximately 2.0 ounces per yard squared.

20. The shelter of claim 19, wherein the insulating middle layer has a thickness greater than approximately 0.15 inches.

21. The shelter of claim 20, wherein the insulating middle layer has an R-value greater than approximately 0.2.

22. The shelter of claim 21, wherein the shelter is portable.

23. The shelter of claim 22, wherein the shelter is a tent.

24. The shelter of claim 23, wherein the shelter is an ice fishing shelter.

25. A method of making a shelter, the method comprising the steps of:

placing a flame-resistant, insulating middle layer between a flame-resistant interior layer and a flame-resistant exterior layer, the middle layer comprising a blend of modacrylic, aramid, and polyester fibers;

quilting the middle layer between the interior layer and the exterior layer with a threaded stitch to form a flame-resistant fabric;

repeating the step of quilting the middle layer between the interior layer and the exterior layer with a threaded stitch to produce at least three parallel quilt lines extending along an entire length of the fabric; and forming the flame-resistant fabric into a shelter.

26. The method of claim 25, wherein the threaded stitch is repeated at intervals of approximately 5-25 inches.

27. The method of claim 26, wherein the step of quilting includes punching holes through the flame-resistant fabric.

28. The method of claim 25, wherein the insulating middle layer has a basis weight greater than approximately 2.0 ounces per yard squared.

29. The method of claim 28, wherein the insulating middle layer has a thickness greater than approximately 0.15 inches.

30. The method of claim 29, wherein the insulating middle layer has an R-value greater than approximately 0.2.

31. The method of claim 30, wherein the flame-resistant fabric has a basis weight greater than approximately 2.5 ounces per yard squared.

32. The method of claim 31, wherein the flame-resistant fabric has a thickness greater than approximately 0.25 inches.

33. The method of claim 32, wherein the flame-resistant fabric has an R-value greater than approximately 0.2.

* * * * *